US005127650A

United States Patent [19]

Schneller

[11] Patent Number: 5,127,650

[45] Date of Patent: Jul. 7, 1992

[54] GOLF PUTTER AND METHOD FOR PUTTING

[76] Inventor: Arthur J. Schneller, 200 E. 27th St., New York, N.Y. 10016

[21] Appl. No.: 735,074

[22] Filed: Jul. 24, 1991

[51] Int. Cl.[5] ..... A63B 53/00

[52] U.S. Cl. ..... 273/81 B; 273/81.3; 273/81.4

[58] Field of Search ..... 273/77 R, 81 R, 81 B, 273/81.3, 81.4, 79, 80 R, 80 A, 80 C, 80.1, 80.2, 80.9, 80.8, 163 R, 163 A, 164, 162 E, 183 D, 183 R, 167 R, 167 C, 167 F, 167 G, 167 J, 169

[56] References Cited

U.S. PATENT DOCUMENTS

| | | | |
|---|---|---|---|
| 1,677,099 | 7/1928 | Harness | 273/81 B |
| 1,967,999 | 7/1934 | Pardoe | 273/81.3 |
| 2,092,839 | 9/1937 | Gouverneur | 273/81.4 |
| 2,949,304 | 8/1960 | Williams | 273/81.3 |
| 3,326,554 | 6/1967 | Scully | 273/81.3 |
| 3,679,207 | 7/1972 | Florian | 273/81 A X |
| 3,874,668 | 4/1975 | Flege | 273/81.3 |
| 4,252,317 | 2/1981 | Vezina | 273/81.3 X |
| 4,491,323 | 1/1985 | Kozub | 273/81.4 |
| 4,621,816 | 11/1986 | Leek | 273/81.3 X |
| 5,037,103 | 8/1991 | Williams et al. | 273/183 R |

*Primary Examiner*—William H. Grieb

*Attorney, Agent, or Firm*—Andrew D. Maslow

[57] ABSTRACT

An improved pendulum golf putter is provided. The putter has an elongated shaft having upper and lower portions. A putter head fixedly mounted to the end of the lower portion of the shaft. A grip is provided having an upper portion and a lower portion, said grip being fixed to the upper portion of the shaft. The upper portion of the grip has a smooth surface adapted to be gripped by all fingers and the palm of the upper hand of the golfer, said upper portion of the grip being substantially in line with the lower portion of the grip. The lower portion of the grip has a non-slip surface which is a sufficient distance from the upper portion of the grip so that during the putting stroke the club can be powered by the lower hand of the golfer while at the same time maintaining the upper hand in a stationary position. The upper portion of the grip further comprises a flattened surface adapted to accommodate the four fingers of the upper hand of the golfer, said surface being in a plane approximately normal to the surface of the putter head.

10 Claims, 4 Drawing Sheets

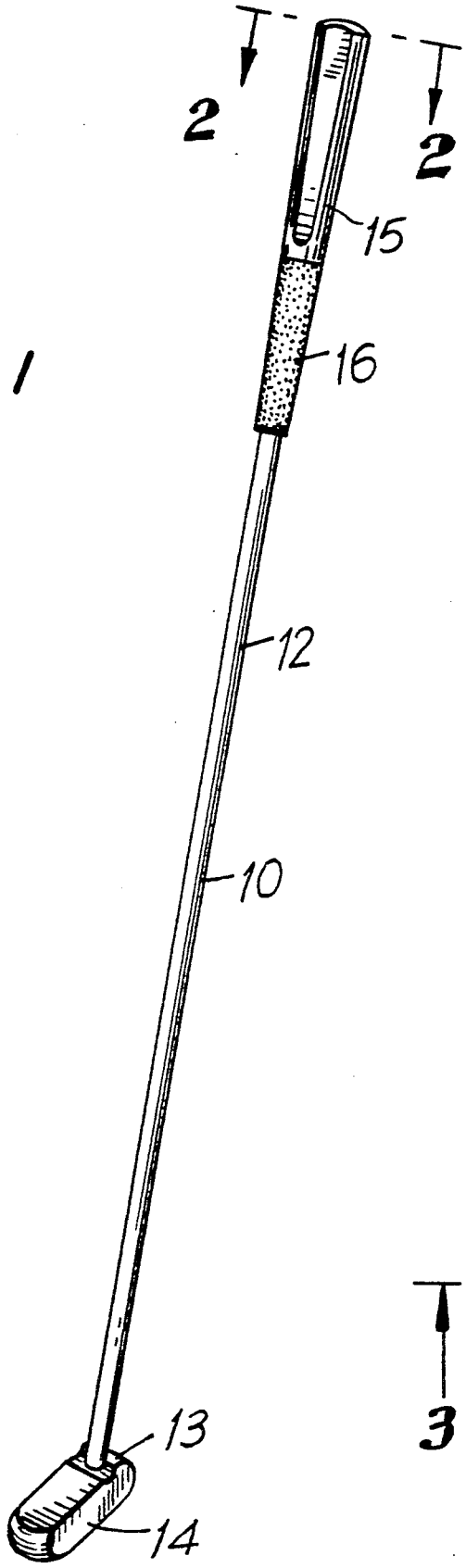
FIG. 1
FIG. 2
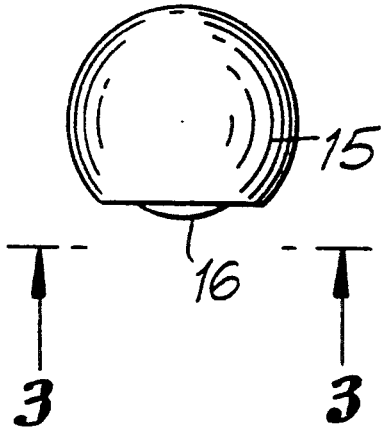

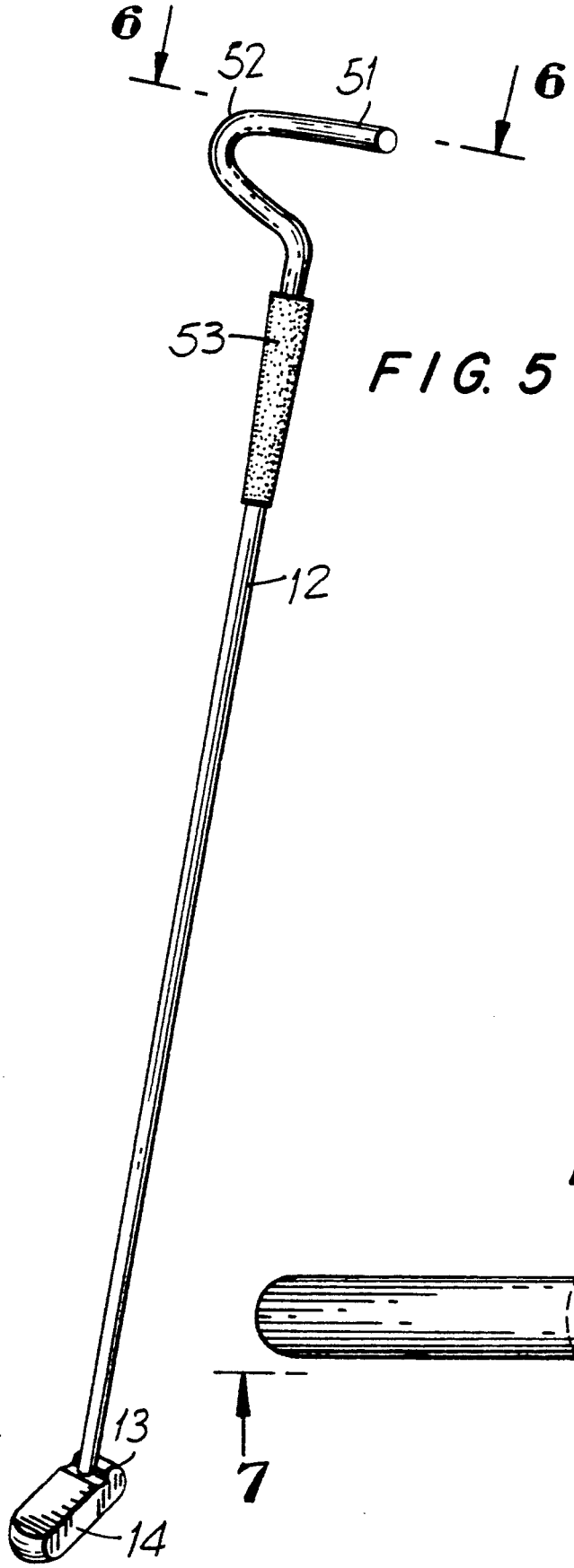
FIG. 5
FIG. 6
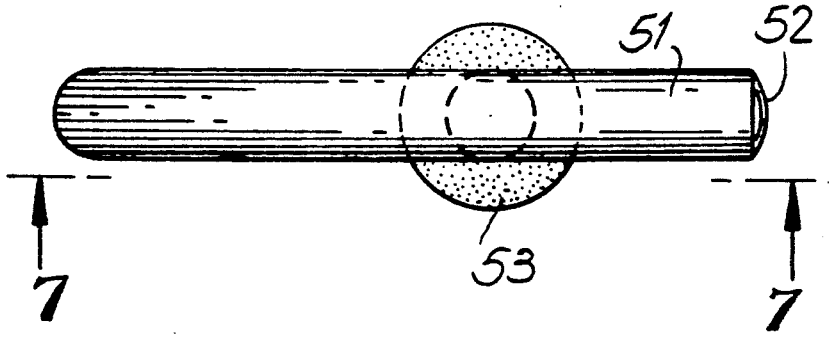

GOLF PUTTER AND METHOD FOR PUTTING

BACKGROUND OF THE INVENTION

1. Field of the Invention

The invention relates to an improved golf club used for putting. The invention also provides an improved method for putting and a specific putter useful for teaching and learning the improved putting method.

2. Description of the Prior Art

Putting is one of the most difficult and controversial parts of playing the game of golf. When putting, if the ball is not hit with the precise amount of strength and at in a precise direction it will either not reach the hole or miss it completely.

Various attempts have been made to design putters that can facilitate the problems incurred in putting. Numerous putters have been provided which are designed to be used with a pendulum motion for stroking the golf ball. These putters suffer various drawbacks in that they encourage movement of the upper or stationary hand. They also encourage movement of the upper body. Such movement tends to alter the direction of the putt.

U.S. Pat. No. 1,967,999 to Pardoe shows a golf club with an angled surface at the extremity of the grip. However, this grip is not designed or even suggested to be used for a putter but rather is for the correction of a hook or a slice when the golfer is hitting a drive. The angled surface lies in a plane at an acute angle to the plane the face of the club.

U.S. Pat. No. 2,949,304 to W. S. Williams discloses a putter designed to be used with a pendulum type motion putting stroke. However, the handle is provided with an extension formed at a right angle to the shaft for the placement the upper hand. The upper hand is not centered over the shaft resulting in increased likelihood that when the putter strikes the ball it is not precisely returned to the angle initially intended. A similar type of putter with the same disadvantage is shown in U.S. Pat. No. 4,252,317 to Vezine.

Another pendulum type putter is shown in U.S. Pat. No. 2,092,839 to Gouverneur. In this putter the upper grip is in the form of a ball extending from a thin web. The plane of the movement of the club is controlled by the fingers lying on either side of the web. This configuration makes it difficult to maintain the precise angle of the club relative to the ball during the putting stroke.

U.S. Pat. No. 4,491,323 to Kozub discloses a putter with separate upper and lower grips and which is designed to be used with a pendulum type putting stroke. However, the upper grip must be gripped between the thumb and an opposing finger. This grip lacks the stability of one which is designed so that the entire upper hand is used to stabilize the upper end of the club.

SUMMARY OF THE INVENTION

In practicing and using the invention the golfer is encourage to maintain the upper end of the putter in a substantially stationary position while imparting the power and direction to the putter solely by use of the lower hand moved through an arc in the direction of the intended putt. It has been found that it is very important that the upper hand be used to stabilize the putter and that the putter be held loosely by the upper hand. This is achieved when the four fingers of the upper hand loosely grip the top of the club with the knuckles facing away from the body. The thumb is placed in an opposing position relative to the four fingers and thus the club is held loosely but in a stable position. This is unlike the grip used with a conventional putter where the upper hand firmly grips the club and is used to impart power and direction in combination with the lower hand. It has been found that the pendulum putters of the prior art all encourage movement of the upper body. This is especially true for the extra long putters now being used and which are held by the upper hand next to the chest of the putter.

It had been found that it is important for the upper hand to be maintained in a position directly over or centered on the shaft of the club in order to minimize any motion of the upper end of the club during a pendulum type of stroke. Maintaining the top of the putter in a substantially stationary position has been found to be one of the most important aspects of successfully using a pendulum type stroke for putting. As stated above, putters using a ball shaped handle for the upper hand do not utilize the entire surface of the palm of the upper hand and all fingers to maintain the upper end of the club in a stationary position during the pendulum type putting stroke. A similar problem is encountered when the upper hand is not directly entered over the shaft of the putter as in the putters with an L-shaped upper handle.

In accordance with the invention an improved putter is provided which includes an elongated shaft, a putter hand fixed to the lower end of the shaft, and separate grips for the upper and lower hands.

The upper grip is designed so that the entire hand is centered over the shaft and can easily control the upper end of the putter and maintain it in a substantially stationary position. While loosely gripping the upper grip, the golfer places his thumb on the grip at the portion closest to his body, his knuckles facing outward. One embodiment has a flat surface upon which the golfer loosely places four fingers. It has been found that it is important that the upper grip have a smooth surface and be adapted to be gripped by all fingers and the palm of the upper hand. When the lower grip has surface which creates friction and the upper grip is smooth, the golfer can feel the difference and is less likely to impart motion to the club with the upper hand. The lower grip is made of a non-slip surface such as rubber or textured leather and must be of a sufficient distance from the upper grip so that during the putting stroke the club can be powered and directed by the lower hand of the golfer while at the same time maintaining the upper hand in a stationary position.

In one embodiment the upper grip includes an angled flattened surface which lies in a plane approximately normal to the plane of the surface of the putting head. The flattened surface is adapted to accommodate the four fingers of the upper hand. In this embodiment the upper grip is substantially in line and above the lower grip.

Another embodiment is designed to be used for leaning how to use the previous embodiment and in particular to teach the golfer the pendulum type stroke while easily maintaining the upper hand in a stationary position. In this embodiment the upper portion of the grip is a question mark shaped handle which may be rotatable in the shaft so that the golfer can adjust the plane of the handle relative to the plane of the face of the putter head. The first end of the handle is rotatably attached to or is an extension of the upper portion of the shaft of the club. The other end of the question mark shaped handle extends past the first end. The question mark shaped handle lies in a plane substantially normal to the plane of the surface of the putting head. Alternatively, it can be adjusted to be parallel to such plane. In either case the upper hand loosely grips the club in a manner similar to the other embodiment, i.e., with the thumb closest to the golfer's body and the knuckles facing outward. In either embodiment it is important that the golfer use a very loose grip with the upper hand and maintain the fingers in a relatively straight position and pointing downward.

Accordingly it is an object of the invention to provide an improved pendulum putter.

A further and more particular object of the invention is to provide a pendulum putter which assists the golfer in maintaining the upper end of the putter in a stationary position but with a loose grip.

Another object of the invention is to provide a putter which engages the golfer to loosely grip the upper end of the club with all fingers and the palm of the hand and at the same time centering the hand over the shaft of the club.

Yet another object of the invention is to provide an improved putter that minimizes upper body movement during the putting stroke.

A still further object of the invention is to provide a system of putters which can be used to instruct the golfer in learning how to properly utilize the pendulum putter and putting stroke.

Still other objects and advantages of the invention will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

FIG. 1 is a perspective view of the improved putter with a straight handle.

FIG. 2 is a top view along plane 2—2 of the putter of FIG. 1.

FIG. 5 is a perspective view of the improved putter with a question mark shaped handle.

FIG. 6 is a top view along plane 6—6 of the putter of FIG. 5.

DETAILED DESCRIPTION OF THE DRAWINGS

Figure 3:
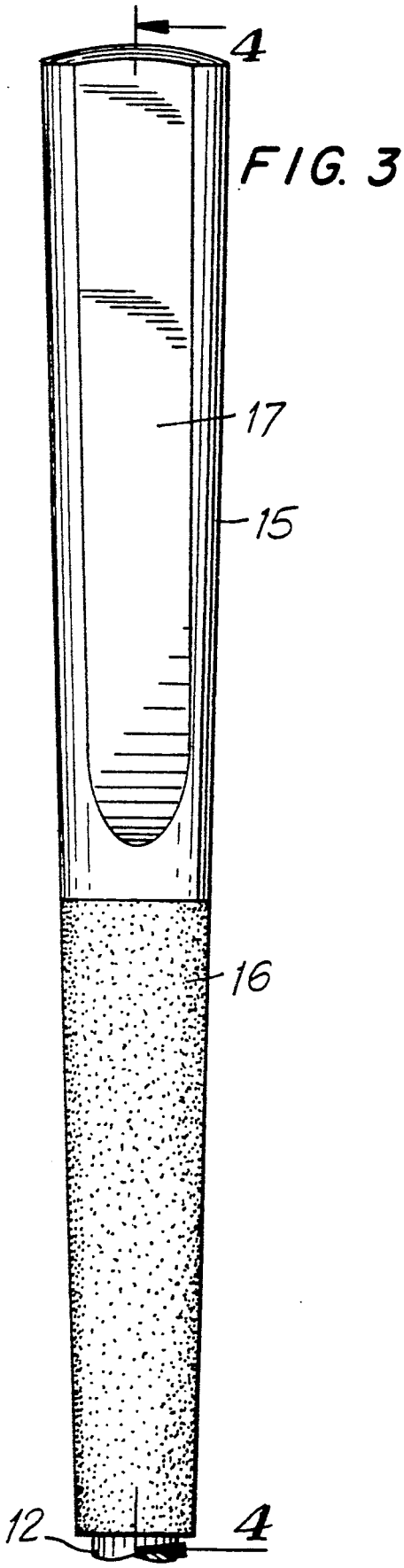
FIG. 3 is a front view along plane 3—3 of the upper and lower grips of the putter of FIG. 1 and FIG. 2.

Putter 10 is shown with a tapered and elongated shaft 12 fixed to a putter head 13. Putter head 13 has a striking face 14 which is adapted to contact the ball during the putting stroke.

The putter is provided with an upper grip 15 and a lower grip 16. Upper grip 15 is made of a hard smooth material such as wood, metal, smooth plastic or fibre. The lower grip 16 is made of a non-slip material such as rubber, a rubberized material or textured leather. The golfer using the putter should make an attempt to stroke the ball by holding the upper grip loosely with the entire upper hand with the knuckles facing away from the golfer's body and maintaining the upper end of the putter in a relatively stationary position. The upper hand serves to maintain the striking surface of the putting head at a fixed angle relative to a plane passing through the center of the ball, said plane being normal to the line passing through the center of the ball and the center of the hole to which the ball is being directed.

The lower hand grips the lower grip 16 and is used to power the club through an arc type motion and still maintaining the striking surface of the putter club in the aforesaid angle relative to the ball to be stroked. The lower grip can be made of any conventional non-slip material used for golf grips generally.

The length o the club is 32 to 40 inches and preferably 36 inches long. The upper grip extends from 5 to 8 inches, preferably 6.25 inches from the top of the club. The lower grip extends from 8 to 12 inches and preferably 10 inches from the lower end of the upper grip.

Figure 4:
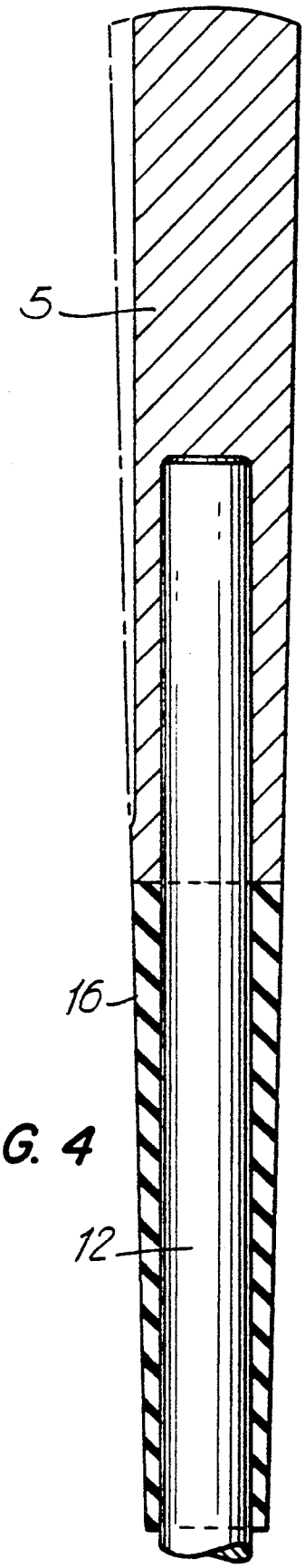
FIG. 4 is a side cross-sectional view along plane 4—4 of the putter of FIG. 1 and FIG. 3.

In the embodiment shown in FIGS. 1, 2, 3 and 4 the upper grip 15 is substantially in line with the lower grip on the shaft and includes an angled flattened surface 17. The flattened surface is preferably neither convex or concave and is designed to accommodate the four fingers of the upper hand gripping the club. The flattened surface 17 lies in a plane approximately normal to the plane of the striking surface 14 of the putter head. It can be seen that a certain deviation from said normal is to expected in the preferred embodiment because of a slight angle of the plane of the flattened surface relative to the axis of the shaft. Another reason that the plane of the flattened surface of the upper grip may deviate slightly from the normal of the plane of the striking surface is the possibility of the striking surface also being at a slight angle from the axis of the shaft. Even with these slight deviations, the plane of the flattened surface should be considered to be approximately normal to the plane of the striking surface of the putting head.

Figure 7:
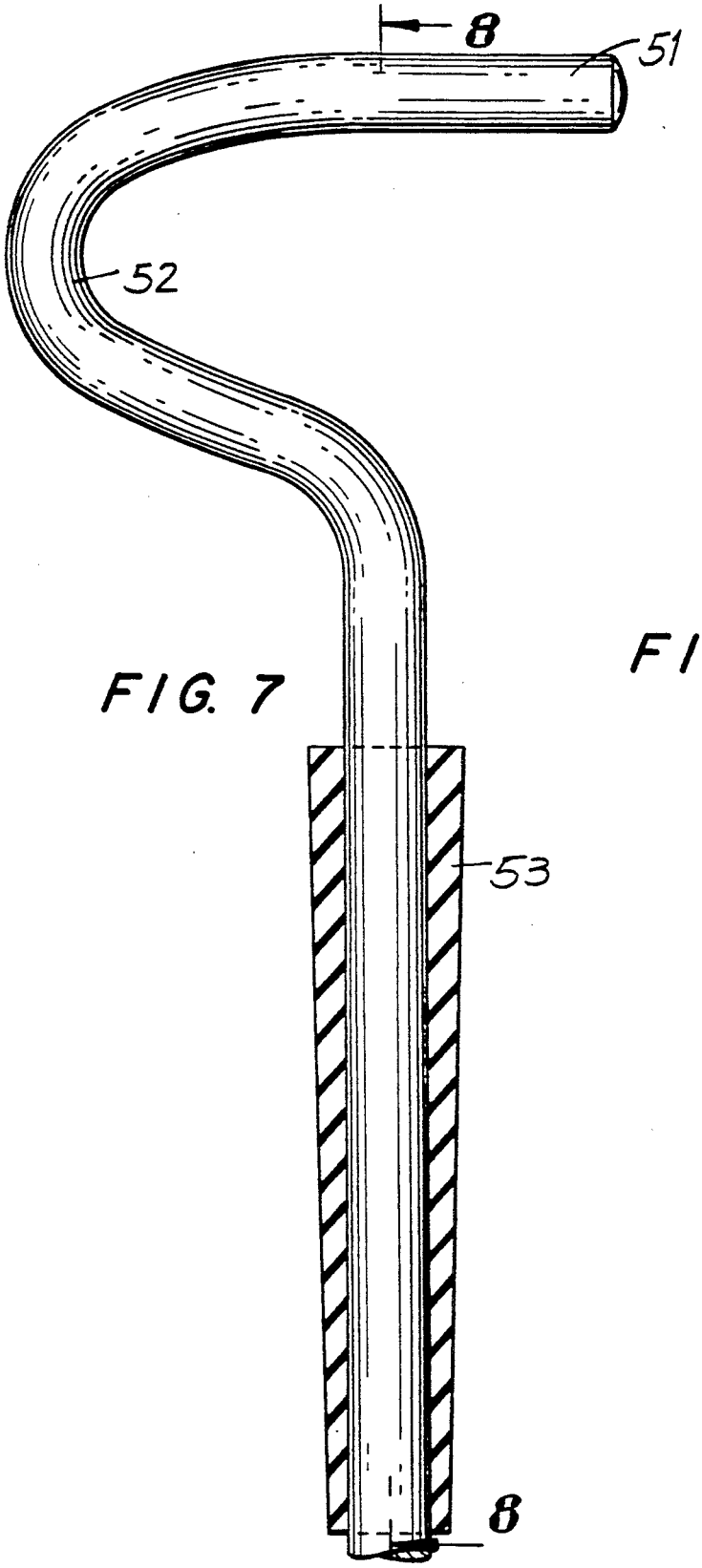
FIG. 7 is a front view along plane 7—7 of the upper and lower grips of the putter of FIG. 5 and FIG. 6.
Figure 8:
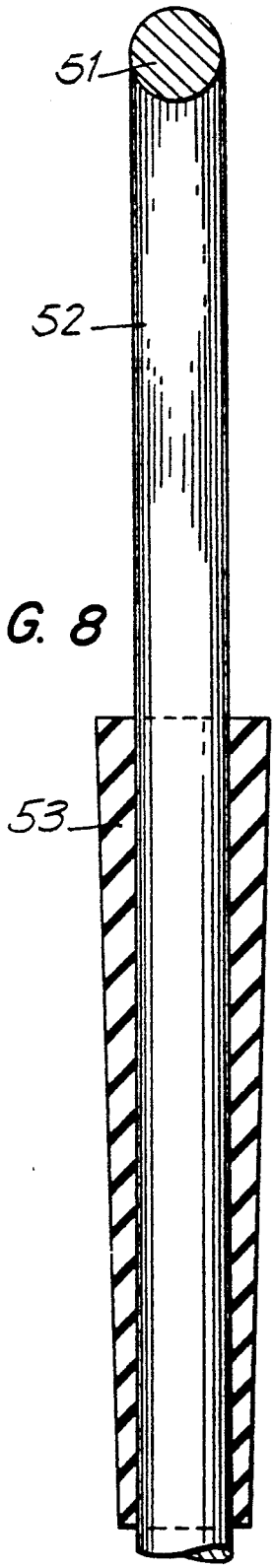
FIG. 8 is a side cross-sectional view along plane 8—8 of the putter of FIG. 5 and FIG. 7.

In the embodiment shown in FIGS. 5, 6, 7 and 8 a U-shaped upper grip is shown. In this embodiment the upper hand is also centered over the shaft. This is accomplished by the extension 51 of the upper end of the question mark-shaped handle 52. The question mark-shaped handle is made from the same smooth material that can be used for the other embodiment. The question mark-shaped handle is easier to hold in a stationary position and thus can be used to teach the golfer how to make a proper pendulum stroke with the upper hand loosely gripping the club and maintaining it in a stationary position while all the while the upper hand is centered over the shaft. After the golfer masters the use of the question mark-shaped handle the use of the previous embodiment will be easier to master. The question mark-shaped upper grip 52 can be made so that it is rotatable inside the lower grip. Thus the golfer can use the club as shown in FIGS. 5–8 or the upper grip may be rotated 90 degrees. When the upper grip is rotated 90 degrees the upper hand is placed over the bend of the upper grip, again with the knuckles facing outward.

The disadvantage of the question mark-shaped handle is that it may not be considered legal to use in some golf tournaments but its use for teaching purposes have been found to be extremely helpful.

It will thus be seen that the objects set forth above, among those made apparent from the preceding description, are efficiently attained and, since certain changes may be made in carrying out the above invention of a putter and method for putting without departing from the spirit and the scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which as a matter of language might be said to fall therebetween.

What is claimed is:

1. An improved pendulum putter to be used by a golfer griping the club with an upper and a lower hand comprising:

an elongated shaft having upper and lower portions;

a putter head fixedly mounted to the end o the lower portion of the shaft and having a striking face;

a grip having an upper portion and a lower portion, said grip being fixed to the upper portion of the shaft;

said upper portion of the grip having a smooth surface adapted to be gripped by four digit fingers and the palm of the upper hand of the golfer, said upper portion of the grip being substantially in line with the lower portion of the grip;

said lower portion of the grip having a non-slip surface and which is a sufficient distance from the upper portion of the grip so that during the putting stroke the club can be powered by the lower hand of the golfer while at the same time maintaining the upper hand in a stationary position;

said upper portion of the grip further comprising a flattened surface adapted to accommodate the four fingers of the upper hand of the golfer, said surface being in a plane approximately normal to the surface of the putter head.

2. The putter of claim 1 wherein the upper portion of the grip is made of wood, metal or a smooth surface plastic or fibre.

3. The putter of claim 2 wherein the lower grip is made of a rubber or rubberized material.

4. The putter of claim 1 wherein the length of the club is 32 to 40 inches.

5. The putter of claim 4 wherein the upper grip extends 5 to eight inches from the top of the upper end of the club and the lower grip extends down 8½ inches from the upper grip.

6. A method of learning to put using a pendulum motion comprising using the putter of claim 1 to put and:

practicing putting by maintaining the upper hand in a substantially stationary position, said upper hand being placed on the upper portion of the putter so that the knuckles of the upper hand face outward, said upper hand loosely gripping the club and being substantially centered over the shaft;

imparting the direction and power to the club by using the lower hand only.

7. An improved pendulum putter to be used by a golfer griping the club with an upper hand and lower hand comprising:

an elongated shaft having upper and lower portions;

a putter head fixedly mounted to the end of the lower portion of the shaft and having a striking face;

a grip having an upper portion and a lower portion being fixed to the upper portion of the shaft;

said upper portion of the grip having a smooth surface adapted to be gripped by all fingers and the palm of the upper hand of the golfer;

said upper portion of the grip comprising a question mark-shaped handle whereby a first end of the question mark-shaped handle is attached to or an extension of the upper portion of the shaft and the other end of the question mark-shaped handle is extended so that it extends past said first end of the question mark-shaped handle, said question mark-shaped handle lying in a plane substantially normal to the plane of the surface of the putting head;

said lower portion of the grip having a non-slip surface and which is a sufficient distance from the upper portion of the grip so that during the putting stroke the club can be powered by the lower hand of the golfer while at the same time maintaining the upper hand in a stationary position.

8. The putter of claim 7 wherein the upper grip is made of wood, metal, or a smooth plastic or fibre.

9. The putter of claim 8 wherein the upper portion of the grip is rotatable relative to the lower portion of the grip.

10. A method of learning to put using a pendulum motion comprising using the putter of claim 6 to put and:

practicing putting by maintaining the upper hand in a substantially stationary position, said upper hand being placed on the upper portion of the putter so that the knuckles of the upper hand face outward, said upper hand loosely gripping the club and being substantially centered over the shaft;

imparting the direction and power to the club by using the lower hand only.

* * * * *